United States Patent [19]

Hammond et al.

[11] 4,042,211

[45] Aug. 16, 1977

[54] PORTABLE DEVICE FOR STRETCHING AND INSTALLING CARPET

[76] Inventors: John M. Hammond, P.O. Box 248, Lugoff, S.C. 29078; Haskell R. Brown, Jr., 93D Georgetown Apt., 1476 Orange Grove Road, Charleston, S.C. 29401

[21] Appl. No.: 669,293

[22] Filed: Mar. 22, 1976

Related U.S. Application Data

[63] Continuation of Ser. No. 555,936, March 6, 1975, abandoned.

[51] Int. Cl.[2] ..... A47G 27/04

[52] U.S. Cl. ..... 254/57

[58] Field of Search ..... 29/238; 254/93 HP, 93 R, 254/57–63

[56] References Cited

U.S. PATENT DOCUMENTS

| | | | |
|---|---|---|---|
| 389,228 | 9/1888 | Knight | 254/62 |
| 520,736 | 5/1894 | Hover | 254/57 |
| 1,160,647 | 11/1915 | Owens | 254/62 |
| 2,606,743 | 8/1952 | Owens | 254/57 |
| 3,001,762 | 9/1961 | Skolnick | 254/62 |
| 3,662,994 | 5/1972 | Johns | 29/239 |

*Primary Examiner*—Al Lawrence Smith
*Assistant Examiner*—Robert C. Watson
*Attorney, Agent, or Firm*—Bailey, Dority & Flint

[57] ABSTRACT

A portable device for stretching carpet and the like for installation over a floor surface comprises a cylinder carried by a handle member having a spring biased piston slideably carried therein, a piston rod connected to the piston extends through one end of the cylinder having a leg member depending therefrom for engaging the carpet to be installed, a support member depending from one end of the handle member being receivable behind a floor mounted wood strip to which the carpet is to be attached, and means for moving the piston so as to overcome the spring bias stretching the carpet engaged by the leg member toward the support member so that it can be attached to the floor mounted wood strip.

11 Claims, 4 Drawing Figures

PORTABLE DEVICE FOR STRETCHING AND INSTALLING CARPET

This is a continuation of application Ser. No. 555,936, filed Mar. 6, 1975 now abandoned.

BACKGROUND OF THE INVENTION

When installing carpet and other floor coverings over the surface of a floor in a wall-to-wall manner, it is necessary to fasten one edge of the carpet at one wall and then to stretch the carpet at the opposite wall so as to secure the opposite edge of the carpet and cause the carpet to lie smoothly upon the floor.

Customarily, a device known as a "kicker" is used to stretch carpet wherein a block having carpet engaging pins in the bottom thereof is engaged in the carpet by the carpet installer who is on his hands and knees and is kicked by the knee of the installer towards the wall to stretch the carpet while installing the edge thereof at the wall. In using such a device, the carpet installer soon tires of the kicking procedure and uniform stretching of the carpet toward the wall cannot be provided. Other prior devices, such as shown in U.S. Pat. Nos. 651,924 and 913,545 have been developed for stretching carpet and the like over the floor surface to be installed wherein various forms of screw rod arrangements are provided to stretch the carpet.

It is not uncommon to attach the carpet to a floor mounted wood strip having upwardly extending tacks imbedded therein for engaging the carpet. The wood strip is spaced slightly away from the wall and none of the prior devices have been suitable for uniformly stretching and installing the carpet in this manner.

SUMMARY OF THE INVENTION

A portable device is provided for stretching carpet and the like for installation over a floor surface comprising an elongated handle member, and a cylinder means carried by the handle member having a spring biased piston assembly slideably carried therein. The piston assembly includes a piston and a piston rod carried thereby. The piston rod extends through one end of the cylinder means and has a vertical leg member depending therefrom. Carpet engaging means is carried at the end of the leg member for engaging the carpet to be installed. A vertical support member depends from one end of the handle member and is receivable behind a floor mounted wood strip to which the carpet is to be attached. A source of pressurized fluid is connected by way of a supply line to the cylinder means and a control valve is connected in the supply line controlling the admission and venting of pressurized fluid to the cylinder means. The piston assembly is moved toward the support member so as to overcome the spring bias during admission of pressurized fluid to the cylinder so as to stretch the carpet engaged by the vertical leg member towards the vertical support member for attachment to the floor mounted wood strip. In this manner, one edge of the carpet may be attached at one wall, and the carpet may be uniformly stretched at the other edge for attachment to the wood strip thereat.

Accordingly, an important object of this invention is to provide a portable device for stretching carpet and other floor coverings for installation over a floor surface which is lightweight and simple in operation.

Another important object of the present invention is to provide a portable device for stretching carpet and other floor coverings for installation over a floor surface which the carpet installer may use the entire day without tiring from the operation thereof.

Another important object of the present invention is to provide a portable device for stretching carpet and other floor coverings for installation over a floor surface which provides uniform stretching of the carpet and a smooth floor covering.

Another important object of the present invention is to provide a portable device for stretching carpet and other floor coverings for installation over a floor surface which provides an adjustable control of the amount and rate of stretching of the carpet.

Another important object of the present invention is to provide a portable device for stretching carpet and other floor coverings for installation over a floor surface which uses an independent power source and eliminates the need of the carpet installer to expend considerable amounts of energy.

The construction designed to carry out the invention will be hereinafter described, together with other features thereof.

The invention will be more readily understood from a reading of the following specification and by reference to the accompanying drawings forming a part thereof, wherein an embodiment of the invention is shown and wherein:

DESCRIPTION OF A PREFERRED EMBODIMENT

Figure 1:
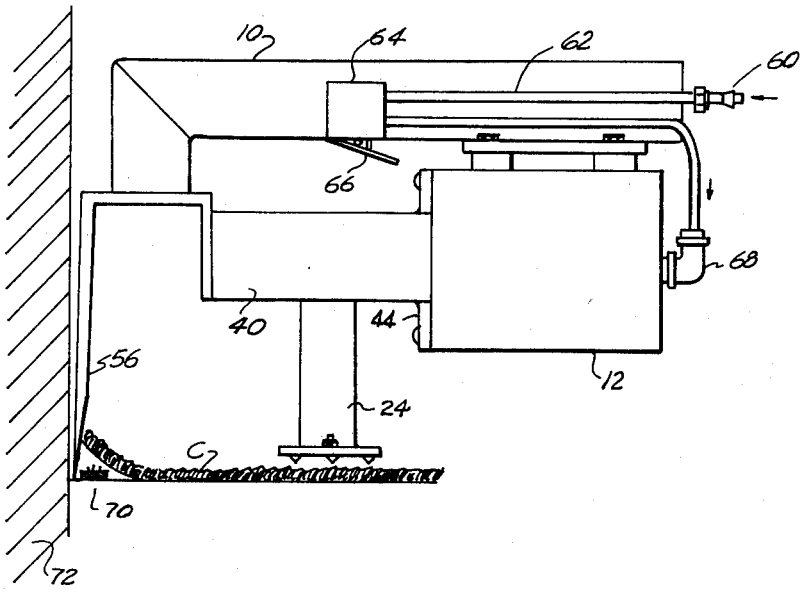
FIG. 1 is an elevational view illustrating a portable device for stretching carpet and the like constructed in accordance with the present invention.
Figure 2:
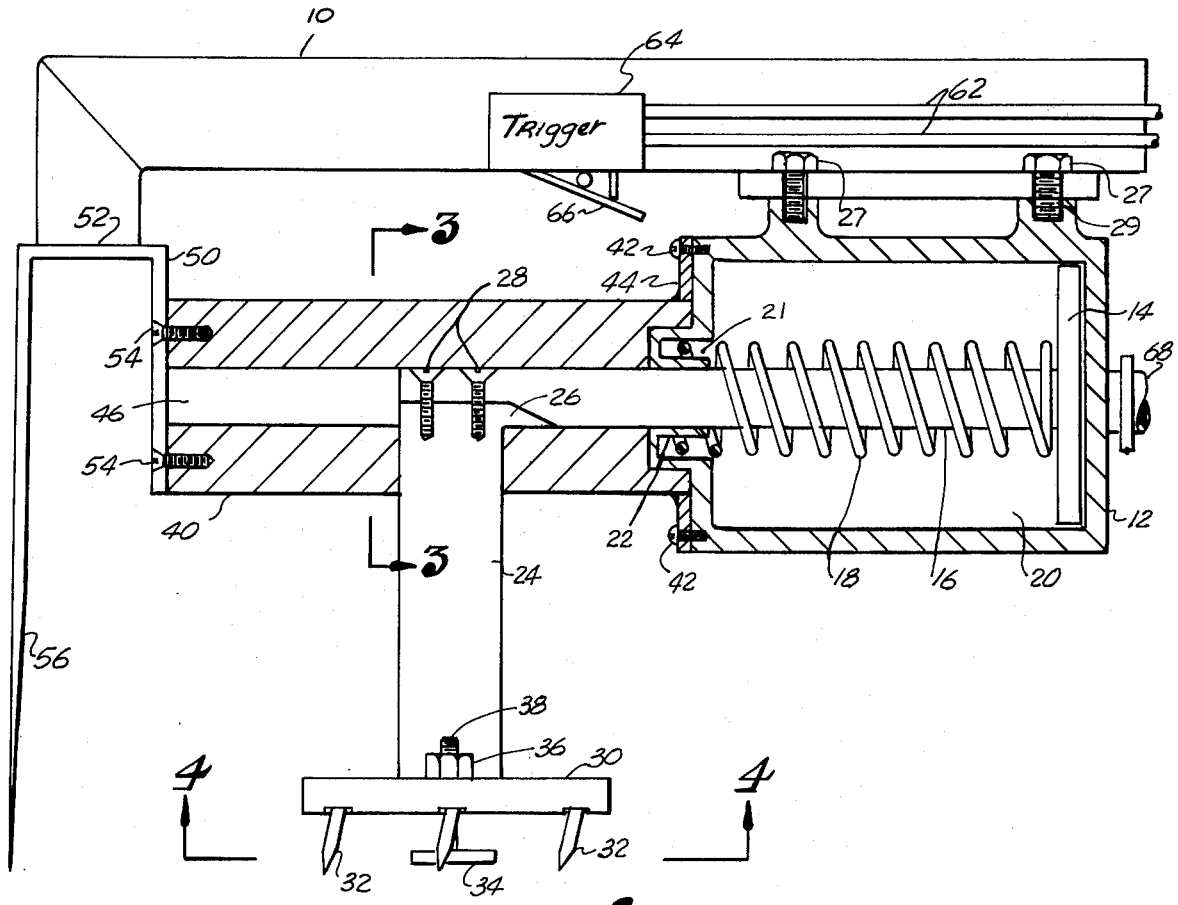
FIG. 2 is a side elevational view of the device in FIG. 1 cut away in part.
Figure 3:
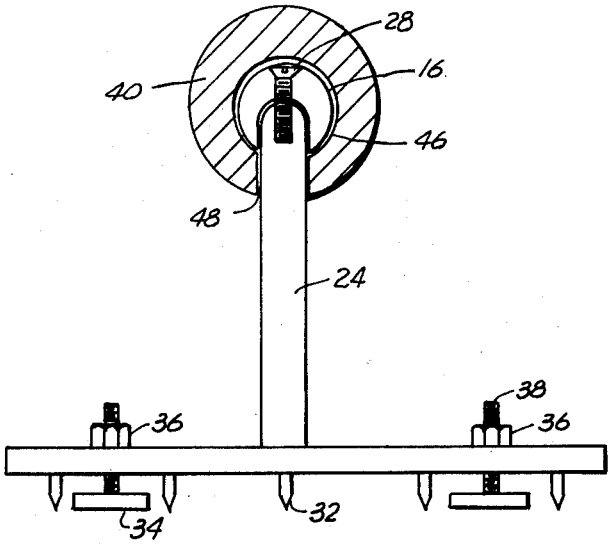
FIG. 3 is a sectional view taken along the line 3—3 of FIG. 2.
Figure 4:
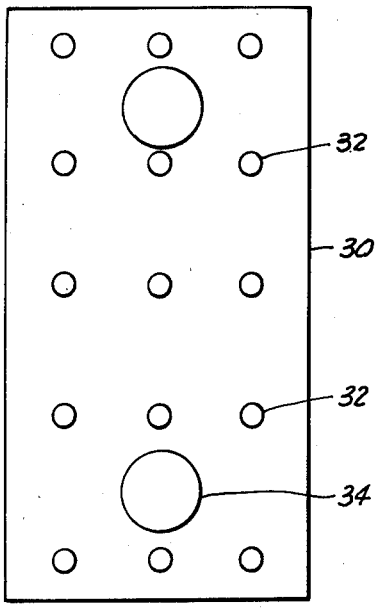
FIG. 4 is a bottom plan view taken along the line 4—4 of FIG. 2.

The drawings illustrate a portable device for stretching carpet and other floor covering for installation over a floor surface comprising an elongated handle member 10 and a cylinder housing means 12 carried by the handle member having a spring biased piston assembly provides a driving member and slideably carried therein. The piston assembly includes a piston 14, a piston rod 16, and a wire spring 18 which encircles the piston rod and biases the piston to the right in the cylinder chamber 20. The piston rod may be a ground and polished alloy steel rod attached to the piston in any conventional manner such as welding or press fitted. The piston rod extends, and is slideably received, through a porous bronze bearing 22 located in one end of the cylinder, and has a vertical leg member 24 depending therefrom. The piston rod may be splined for receiving a key 26 of the vertical leg which may then be fastened to the rod as by screws 28. Bolt members 27 fasten the handle member and cylinder together and are received in threaded holes 29 formed in the cylinder.

A bottom horizontal plate member 30 is carried transversely by the vertical leg and may be attached as by welding and the like thereto. Engaging means for engaging the carpet to be installed is provided by a plurality of pins 32 carried in the bottom of the plate. The pins may be press fitted into the bottom of the plate or carried therein in any suitable manner. An adjustable stop member 34 is threadably carried in the plate member 30 for adjustably limiting the depth of engagement of the pins 32 into the carpet fabric. Nut members 36 are received over the threaded stem 38 of the stop member to lock the stop member in place at the desired level.

A barrel member 40 is carried integrally aligned with the cylinder means and is attached thereto by screws 42 which pass through the cover plate 44 into the walls of the cylinder. The cover plate may be fastened to the barrel member as by welding and the like. The barrel member includes a longitudinal circular groove 46 extending centrally therein providing a guide means for receiving and guiding the end of the piston rod which extends through the cylinder 12 in linear movement. The circular opening of the groove is aligned with the circular opening of the bearing 22. The barrel member further includes a radial slot 48 which extends from the groove 46 through an outer surface of the barrel member for receiving the vertical leg 24 outwardly therethrough. The barrel member is fastened at an end opposite the cylinder means to one leg 50 of a substantially U-shaped bracket member 52 which is made integral with the elongated handle member 10 and depends downwardly therefrom. The barrel member 40 is fastened to the leg 50 by screws 54.

The other leg of the bracket 52 provides a vertical support member 56 depending from the elongated handle member 10 which is receivable behind a fastening member 70. The fastening member may be any suitable strip or other fastening means to which the carpet is attached such as a floor mounted wood strip 70 spaced closely adjacent a vertical wall 72 having a plurality of upwardly extending tacks imbedded therein to which the carpet may be attached. Therefore, as the leg member 24 is caused to move towards the support member 56, in a manner to be more fully described later, the carpet engaged thereby is stretched toward the support member and wood strip to which it is to be attached. The support member 56 is preferably a plate of general triangular shape having its base along the bottom thereof for resting on the floor surface behind the wood strip and being tapered upwardly.

Any suitable source of outside energy may be used to power or move the rod 18 such as electric power or hydraulic power. If electrical power is desired to be used, a suitable screw gear could be used in combination with a small electric motor or electric drill combination. However, in a preferred embodiment, as disclosed, the rod is powered or moved by a pressurized fluid applied to the cylinder and piston assembly combination. An external source of pressurized fluid is provided and is attached to the inlet fitting 60 of a supply line 62 which connects the source of pressurized fluid with the internal cylinder chamber 20. The fluid may be any suitable fluid such as compressed air, and is regulated to a pressure of approximately 60 psi. A control means is provided by control valve 64 connected in the supply line for controlling the admission and venting of the pressurized fluid in the cylinder means. The control valve is controlled in an adjustable manner by the trigger 66 which is carried in the handle member and extends outwardly therefrom. The control valve may be any conventional two-way valve, such as a "Micro-Line" valve, Model MV-10, manufactured by Mead Fluid Dynamics, a Division of Stanray, Inc. The valve has a first position to admit the pressurized fluid to the cylinder chamber causing the piston assembly to move against the bias of spring 18, and which is operable in a second position to vent the cylinder chamber to the atmosphere for bleeding the pressurized fluid out of the cylinder so as to permit the piston assembly to return to its original position under the spring biasing force. The valve is completely adjustable as to the amount and rate at which the pressurized fluid is allowed to move the piston by depressing the trigger accordingly. Since different floor coverings of different quality, weight, and material would require different stretching forces. The supply line 62 conveys pressurized fluid to the valve and then carries the pressurized fluid to a fitting 68 on the cylinder for admission thereto. Likewise, the supply line conveys the pressurized fluid out of the cylinder chamber when the valve is in its venting position.

In use, for installing a floor covering in a wall-to-wall manner, the floor covering such as carpet is installed at one edge to one side of the room at the wall and is then laid across the floor surface to the opposite wall. The portable carpet stretching device is then hand carried by the carpet installer to the side of the room for installing the unattached edge of the carpet. The portable device engages the carpet by the engaging pins and the support member 56 is received behind the floor mounted wood strip 70 which has a plurality of upwardly extending tack members imbedded therein to which the carpet is attached. Once the portable device is in this position, the trigger is operated so as to admit pressurized fluid to the cylinder chamber causing the engaging means to move towards the support member lodged behind the wood strip stretching the carpet towards the wall. When the carpet is stretched the desired amount to provide a smooth floor covering, the carpet installer attaches the loose edge of the carpet to the tacks carried in the wood strip. Thereafter the portable device is removed and the edge of the carpet is tucked down into the space between the wall and wood strip to give a finished appearance. In this manner the carpet installer moves down the entire width of the wall to stretch and install the carpet thereat resulting in a flat, smooth floor covering over the entire floor surface. The operation is then repeated for the remaining pair of opposing walls of the room in which the carpet is being installed.

Thus, it can be seen that a light weight and simple in operation portable device is provided for stretching carpet and other floor covering to be installed over a floor surface. The device is compact and requires little effort by the carpet installer leaving most of his energy available to making sure the carpet is installed smoothly and uniformly across the floor surface. The device may be used on any type of floor covering since the stretching may be controlled by the controlled amount of pressurized fluid admitted to the cylinder. The portable device has few moving parts subject to wear and can be used durably day-in and day-out. The carpet stretching device may be used to stretch carpet and the like for installation over a floor surface either with or without the use of a floor mounted wood strip.

While a preferred embodiment of the invention has been described using specific terms, such description is for illustrative purposes only, and it is to be understood that changes and variations may be made without departing from the spirit or scope of the following claims.

We claim:

1. A portable carpet stretching device for stretching carpet and the like over a floor surface for attachment to a fastening member secured to the floor surface closely adjacent a vertical wall comprising:

a. an elongated member positioning said device over said floor surface;

b. cylinder means carried by said elongated member having a piston assembly slideably carried therein for being actuated by a source of pressurized fluid;

c. said piston assembly including a piston and a piston rod carried thereby, said piston rod extending through an end of said cylinder means having a leg member depending therefrom, d. carpet engaging means carried by said leg member for engaging carpet to be installed, e. a support member depending from said elongated member being receivable behind said fastening member to which the carpet is to be attached, f. a supply line for connecting said pressurized fluid source with said cylinder means, and g. adjustable control means connected in said supply line controlling the admission and venting of pressurized fluid in said cylinder means so as to adjustably control the movement of said piston assembly, said piston assembly being moved towards said support member during admission of pressurized fluid to said cylinder means so as to stretch the carpet engaged by said leg member a controlled amount towards said support member.

2. The device of claim 1 further comprising a barrel member carried integrally aligned with said cylinder means having a longitudinal groove extending therein for receiving said piston rod extending through an end of said cylinder means, said barrel member including a radial slot extending from said groove through an outer surface of said barrel for receiving said leg member outwardly therethrough.

3. The device of claim 1 wherein said engaging means includes a plate member carried transversely at one end of said leg member having a plurality of pins carried on the bottom thereof for engaging the carpet to be installed.

4. The device of claim 3 wherein said plate member includes means carried on the bottom thereof for adjustably limiting the depth of engagement of said pins.

5. A portable device for stretching carpet and the like over a floor surface for attachment to a fastening member secured to the floor surface closely adjacent a vertical wall comprising:

a. an elongated member;

b. a barrel member carried by said elongated member having a longitudinal groove extending centrally therethrough;

c. a radial slot extending outwardly from said groove through an outer surface of said barrel member;

d. a rod slideably carried in said groove having a leg member depending therefrom extending through said radial slot outwardly away from said barrel member;

e. engaging means carried by said leg member for engaging the carpet to be installed;

f. a support member depending from said elongated member adjacent one end thereof being receivable behind said fastening member to which the carpet is to be attached; and g. means for moving said rod and thus said leg member towards said support member thereby stretching the carpet engaged by said engaging means for installation and attachment to the fastening member.

6. The device of claim 5 wherein said engaging means includes a plate member carried transversely at one end of said leg member having a plurality of pins carried on the bottom thereof for engaging the carpet to be installed.

7. The device of claim 6 wherein said plate member includes means carried on the bottom thereof for adjustably limiting the depth of engagement of said pins.

8. The device of claim 5 wherein said means for moving said rod includes a spring biased piston integrally connected to said rod, said piston being slideably received in cylinder means carried integrally aligned with said barrel member; and means for moving said piston against the spring bias in said cylinder means.

9. The device of claim 8 wherein said means for moving said piston includes a source of pressurized fluid connected to said cylinder means, and control means connected between said source and said cylinder means for controlling admission of said fluid to move said piston against said spring bias and venting of said fluid in said cylindrical chamber.

10. A portable carpet stretching device for stretching carpet and the like over a floor surface for attachment to a fastening member secured to the floor surface closely adjacent a vertical wall comprising:

an elongated member for positioning said device above a floor surface, housing means carried by said elongated member having a driving member carried therein for being energized and driven by an external power source;

a reciprocating rod member driven by said driving member, at least a part of said rod member extended outwardly from said housing means having a leg member depending downwardly therefrom;

carpet engaging means carried by said leg member for engaging carpet to be installed:

a support member depending from said elongated member receivable behind said fastening member to which the carpet is to be attached;

a supply line for connecting said external power source with said driving member;

adjustable control means connected in said supply line for selectively connecting said driving member to said power source so that said driving member is energized to move said rod member a desired amount; and said rod member being movable towards said support member when energized by said power source so as to stretch the carpet engaged by said leg member towards said support member for installation and attachment to said fastening member.

11. The device of claim 10 further comprising guide means carried by said elongated member for receiving said rod member and guiding said rod member in linear movement.

* * * * *